US008523478B2

(12) United States Patent
Swahlan et al.

(10) Patent No.: US 8,523,478 B2
(45) **Date of Patent: *Sep. 3, 2013**

(54) VEHICLE BARRIER WITH ACCESS DELAY

(75) Inventors: David J. Swahlan, Tijeras, NM (US); Jason Wilke, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/477,946

(22) Filed: May 22, 2012

(65) Prior Publication Data

US 2012/0251238 A1 Oct. 4, 2012

Related U.S. Application Data

(63) Continuation of application No. 12/559,594, filed on Sep. 15, 2009, now Pat. No. 8,210,767.

(51) Int. Cl.
*E01F 13/00* (2006.01)

(52) U.S. Cl.
USPC ..... 404/6; 256/1

(58) Field of Classification Search
USPC ..... 404/6; 256/1, 13.1
See application file for complete search history.

(56) References Cited

U.S. PATENT DOCUMENTS 4,576,507 A 3/1986 Terio
4,784,515 A 11/1988 Krage et al.
4,822,207 A 4/1989 Swahlan
5,078,366 A 1/1992 Sicking et al.
6,022,003 A 2/2000 Sicking et al.
6,561,492 B1 5/2003 Hubbell
6,926,461 B1 8/2005 Faller et al.
7,037,028 B1 5/2006 Donohoe et al.
7,544,009 B2 6/2009 Bergendahl et al.
8,210,767 B1 * 7/2012 Swahlan et al. ..... 404/6
2006/0045617 A1 3/2006 Faller et al.

OTHER PUBLICATIONS

Payne Fence Products, LLC, Product Brochure, "The Normandy Barrier" [online] [retrieved on Aug. 3, 2009] retrieved from the Internet: <URL: http://www.paynefence.com/fullaccess/Brochures/I%20-%20Payne%20Normandy%20Barrier.pdf>, 2 pp.

* cited by examiner

*Primary Examiner* — Gary Hartmann
(74) *Attorney, Agent, or Firm* — Daniel J. Jenkins

(57) ABSTRACT

An access delay vehicle barrier for stopping unauthorized entry into secure areas by a vehicle ramming attack includes access delay features for preventing and/or delaying an adversary from defeating or compromising the barrier. A horizontally deployed barrier member can include an exterior steel casing, an interior steel reinforcing member and access delay members disposed within the casing and between the casing and the interior reinforcing member. Access delay members can include wooden structural lumber, concrete and/or polymeric members that in combination with the exterior casing and interior reinforcing member act cooperatively to impair an adversarial attach by thermal, mechanical and/or explosive tools.

18 Claims, 4 Drawing Sheets

VEHICLE BARRIER WITH ACCESS DELAY

STATEMENT REGARDING FEDERALLY SPONSORED RESEARCH OR DEVELOPMENT

The United States Government has certain rights in this invention pursuant to Department of Energy Contract No. DE-AC04-94AL85000 with Sandia Corporation.

FIELD OF THE INVENTION

The invention generally relates to vehicle barriers of the modified Normandy type. The invention further relates to vehicle barriers having access delay features incorporated into their construction, thereby delaying and/or preventing attempts by an adversary to defeat, compromise, or remove the barrier.

BACKGROUND OF THE INVENTION

A need exists for vehicle barriers that prevent unauthorized vehicular access to secure and/or high value facilities such as embassies, nuclear power generating stations and military installations. Barriers developed for these applications are often tested using guidelines established by the standard: ASTM F 2656-07 Standard Test Method for Vehicle Crash Testing of Perimeter Barriers. Vehicle barriers designed to meet or surpass this standard are intended to prevent a vehicle such as a medium sized truck, perhaps equipped with an explosive device, from ramming through the barrier. Such barriers can include for example, steel or concrete monolithic structures and can be subject to attack (e.g. defeat, compromise or removal) by an adversary equipped with simple thermal, explosive and/or mechanical tools, such as a cutting torch, powered saw, diamond saw, abrasive cut-off wheel, explosive device and shaped charge. There is therefore an unmet need for a vehicle barrier incorporating access delay features that can not only stop an unauthorized vehicle in a ramming attack, but additionally can prevent or delay an adversarial attack with thermal, explosive and/or mechanical tools. The present invention provides substantial access delay features in a vehicle barrier, without compromising the barriers' ability to physically stop an impacting vehicle. Embodiments of the present invention can incorporate multiple defeat resistant, access delay elements. Embodiments of the present invention additionally provide for minimal visual obstruction of their setting and do not provide hiding places for adversaries, which can be problematic in the deployment of massive concrete walls or devices commonly known as "Jersey" barriers.

BRIEF DESCRIPTION OF THE DRAWINGS

The accompanying drawings, which are incorporated in and form part of the specification, illustrate embodiments of the present invention and, together with the description, serve to explain the principles of the invention.

DETAILED DESCRIPTION OF THE INVENTION

Figure 1:
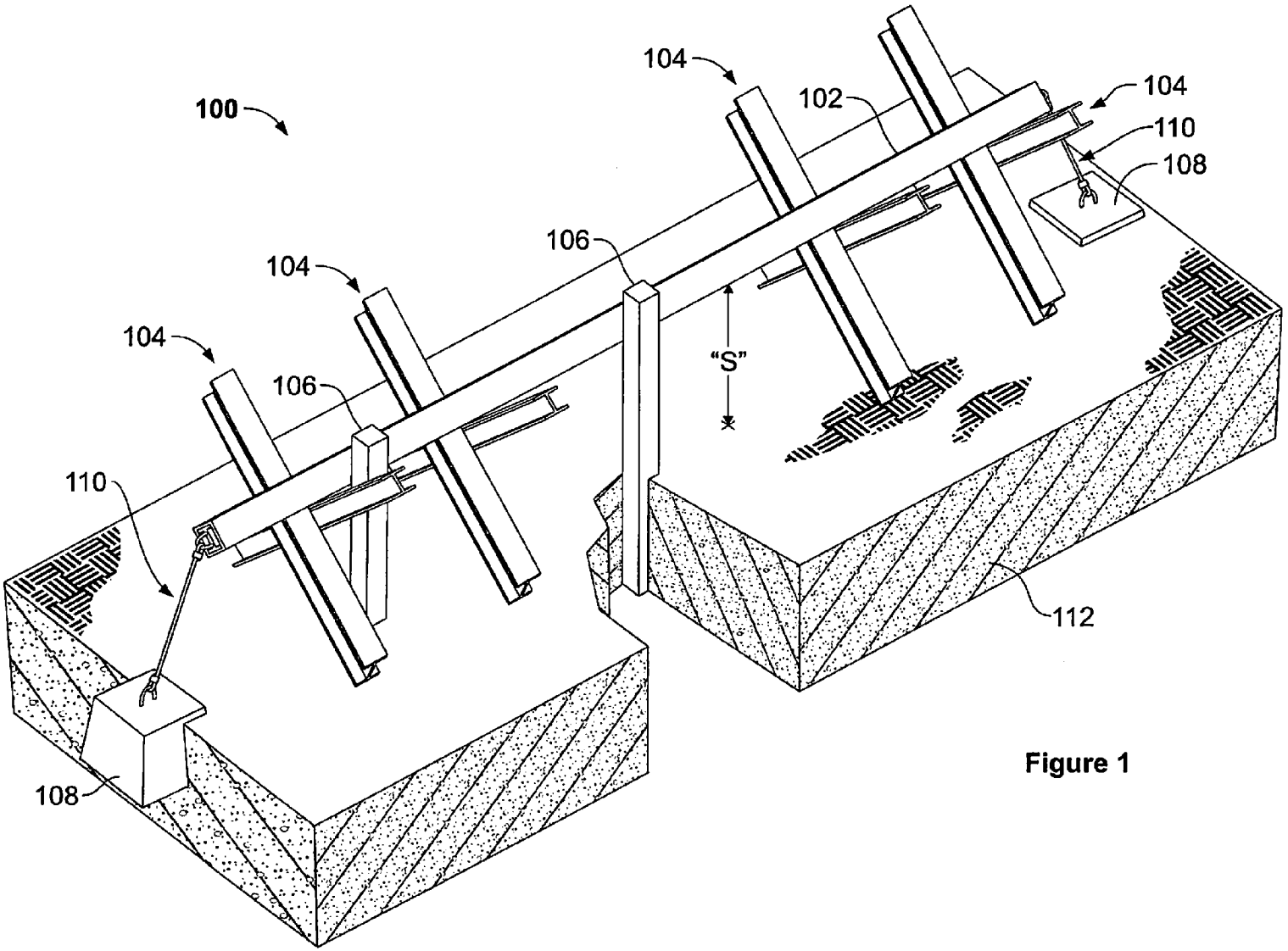
FIG. 1 is a schematic illustration of an embodiment of an access delay vehicle barrier, according to the present invention.

FIG. 1 is a schematic illustration of an embodiment of an access delay vehicle barrier, according to the present invention. In this exemplary non-limiting embodiment, vehicle barrier 100 includes a horizontally disposed barrier member 102 (incorporating access delay features as discussed below) supported on free standing supports 104 (see detail FIG. 2) that serve to maintain the barrier member 102 above a surface 112 (e.g. the local terrain) by a stand-off distance "S". In this exemplary embodiment, a stand-off distance "S" approximately equal to thirty inches was used. Supports 104 are said to be "free standing" in that they are not intentionally embedded, buried or set into the surface (e.g. the earth, paved roadway etc.) but merely rest on the surface 112. In this manner, a vehicle impacting the barrier 100 can cause lateral displacement of the barrier member 102 relative to the surface 112 by the action of sliding the free standing supports 104 along the surface. Free standing supports 104 can be fixedly connected (e.g. by welds, threaded connectors etc.) to the barrier member 102.

Figure 3:
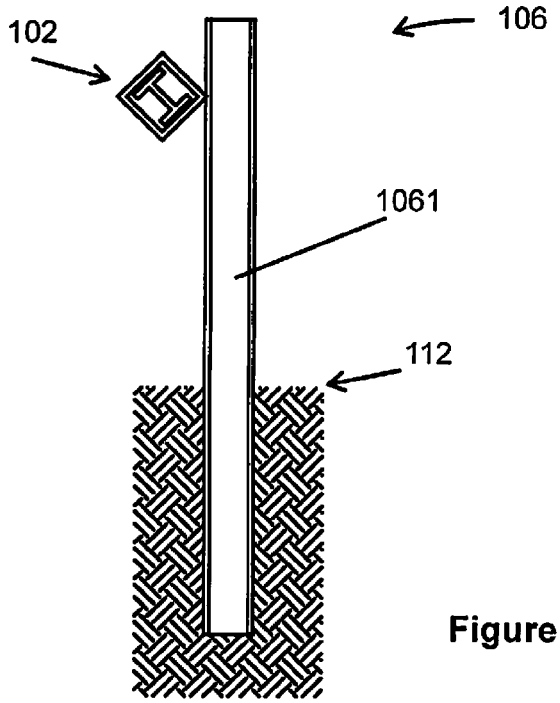
FIG. 3 is a schematic detail illustration of an embodiment of a vertical fixed post support proximal to a horizontal barrier member, according to the present invention.

In addition to the free standing supports 104, vehicle barrier 100 can include fixed post supports 106 that are disposed proximal to (e.g. can be contacting) but may or may not be not fixedly connected to the horizontal barrier member 102 (see detail FIG. 3). Fixed post supports are intentionally embedded into the surface 112, for example driven into the earth or set in concrete post-holes. In one exemplary embodiment, free standing supports 104 were disposed at approximately eight foot intervals along the horizontal barrier member 102 and fixed post supports 106 were disposed at approximately fifty six foot intervals along the horizontal barrier member 102. In applications of the vehicle barrier 100, the number and spacing of fixed 106 and free standing supports 104 can be adjusted as desired to meet the needs of the particular application. In particular, the fixed post supports 106 are designed and engineered to allow gradual deceleration of the impacting vehicle. Such gradual deceleration limits the amount of vehicle damage and deformation which could lead to continued travel of the load (e.g. explosives) into a protected area. In order to accomplish this goal the material, number, size, spacing and anchoring of the vertical posts can be modified to tailor the vehicle barriers' response to an applications' perceived threats.

Vehicle barrier 100 can additionally include anchor members 108 generally disposed at either end of a horizontal segment of a barrier member 102 to fixedly anchor the barrier member 102 to the surface 112. Anchor members 108 can include concrete blocks embedded into the surface 112 (e.g. buried or formed and poured in the earth) and can be tied via steel cables 110, rods or struts to the barrier member 102. Anchor members 108 can as well include anchoring devices that can be driven or screwed into the earth or set in concrete embedments, or can additionally include fixed post supports (such as 104) disposed at the ends of a barrier member 102. Anchor members can additionally include access delay features as described below. As illustrated in FIG. 1, embodiments of vehicle barriers with access delay features provide little visual obstruction of the setting they are placed into, and/or provide few if any hiding places for adversaries.

Figure 2:
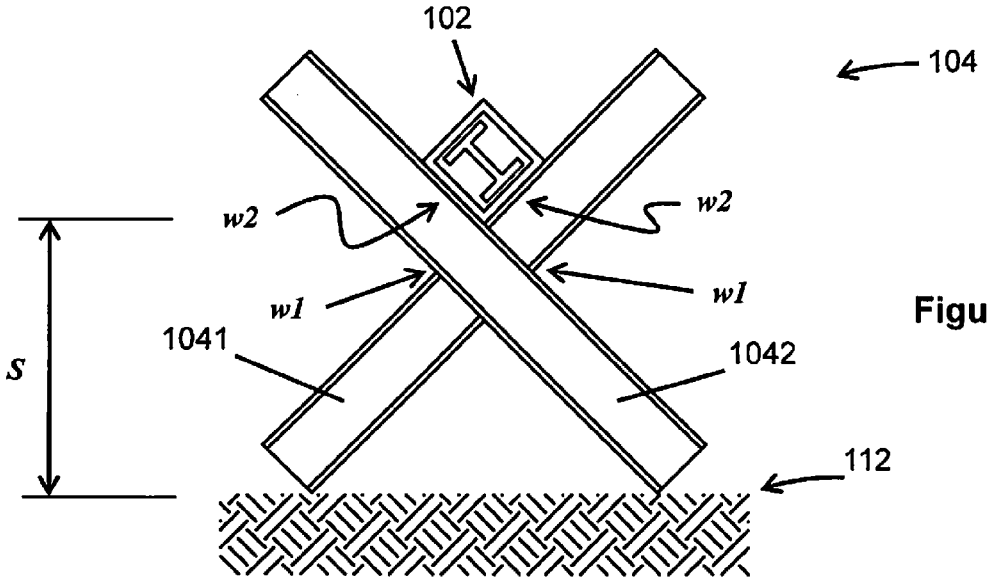
FIG. 2 is a schematic detail illustration of an embodiment of a free standing vertical support formed by crossed I-beams, according to the present invention.

FIG. 2 is a schematic detail illustration of an embodiment of a free standing vertical support formed by crossed I-beams, according to the present invention. In one exemplary embodiment, a free standing support 104 can be constructed of W6x15 ASTM A992 wide flange fabricated into "X" shaped supports. Flange members 1041 and 1042 can be crossed at any angle of convenience (e.g. 45 degrees in this illustration) and can be connected together by welding (at areas generally denoted by "W1") or through the use of threaded fasteners for example. Horizontal barrier member 102 can be set into the "V" created by the crossed flange members of support 104 and can further be connected to the support 104 by welding (at areas generally denoted by "W2") or through the use of threaded fasteners. As noted above, free standing supports 104 are not intentionally embedded into the surface 112, although some natural settling of the supports 104 into the surface 112 can occur for example, due to the weight of the horizontal barrier member 102, without impacting the practice of the invention.

FIG. 3 is a schematic detail illustration of an embodiment of a vertical fixed post support proximal to a horizontal barrier member, according to the present invention. In one exemplary embodiment, fixed post supports 106 can be constructed of W6x15 ASTM A992 wide flange members spaced fifty six feet apart on center and can be embedded fifty six inches into the surface 112. Fixed post supports 106 can be driven into the earth, or can as well be embedded in compacted soil or concrete embedments. Fixed post support 106 is disposed proximal to (e.g. can be touching) Horizontal barrier member 102 and may or may be not be fixedly connected to the horizontal barrier member 102 (e.g. by welding or threaded fasteners). Fixed post support 106 can provide lateral support to the barrier member 102 but may or may not provide vertical support to the barrier member.

Figure 4:
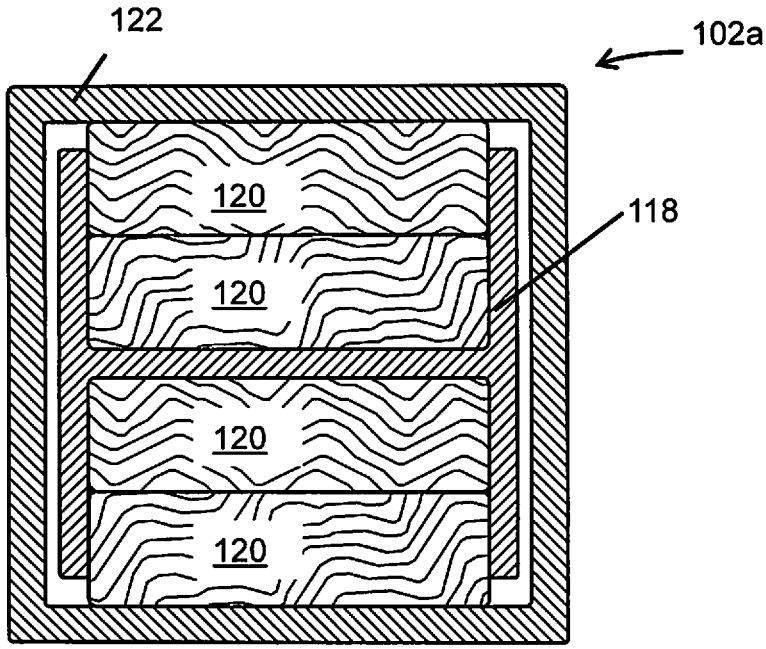
FIG. 4 is a schematic cross-sectional detail of an embodiment of a horizontal barrier member, according to the present invention.

FIG. 4 is a schematic cross-sectional detail of an embodiment of a horizontal barrier member, according to the present invention. In this exemplary embodiment, horizontal barrier member 102*a* can be constructed of a W6x25 ASTM A992 wide flange interior steel reinforcing member 118 inserted into an 8×8×½ inch ASTM A500 Grade B square tube exterior steel casing 122 with access delay members 120 inserted between the web of the wide flange 118 and the square exterior casing 122. In this exemplary embodiment, the access delay members 120 consisted of wooden 2"×6" dimensioned lumber. It has been found that the inclusion of the access delay members 120 within the barrier member 122 impairs and delays an adversary that may attempt to remove or defeat a barrier by use of mechanical, thermal or explosive means. For example a cutting tool (e.g. cut-off wheel) that might be effective in cutting through the steel casing 122 would be substantially ineffective in cutting through the wooden access delay members 120. Similar analyses hold true for thermal and explosive tools. Access delay members 120 could as well comprise concrete and/or polymeric members. Additionally, reactive materials that smoke or emit noxious fumes when heated or attacked can be used as well. Hardened objects/materials may be embedded in this area to further frustrate cutting attacks.

Figure 5:
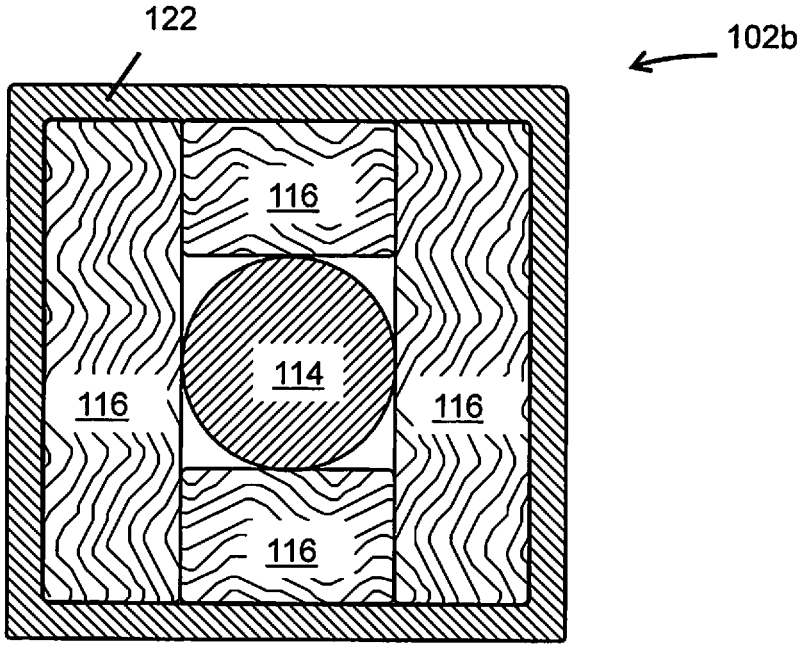
FIG. 5 is a schematic cross-sectional detail of another embodiment of a horizontal barrier member, according to the present invention.

FIG. 5 is a schematic cross-sectional detail of another embodiment of a horizontal barrier member, according to the present invention. In this exemplary embodiment, horizontal barrier member 102*b* can be constructed of three inch diameter A36 steel round stock as the interior reinforcing member 114 inserted into an 8×8×½ inch ASTM A500 Grade B square tube exterior steel casing 122. In this example, access delay members 116 comprise dimensioned lumber inserted within the casing 122, between the casing 122 and the interior reinforcing member 114. As above, access delay members 116 could as well comprise concrete and/or polymeric members. The interior reinforcing member 114 could as well comprise a solid member of square cross-section, a steel cable, chain, laminates of several materials, or any other tensile force resistant medium.

Figure 6:
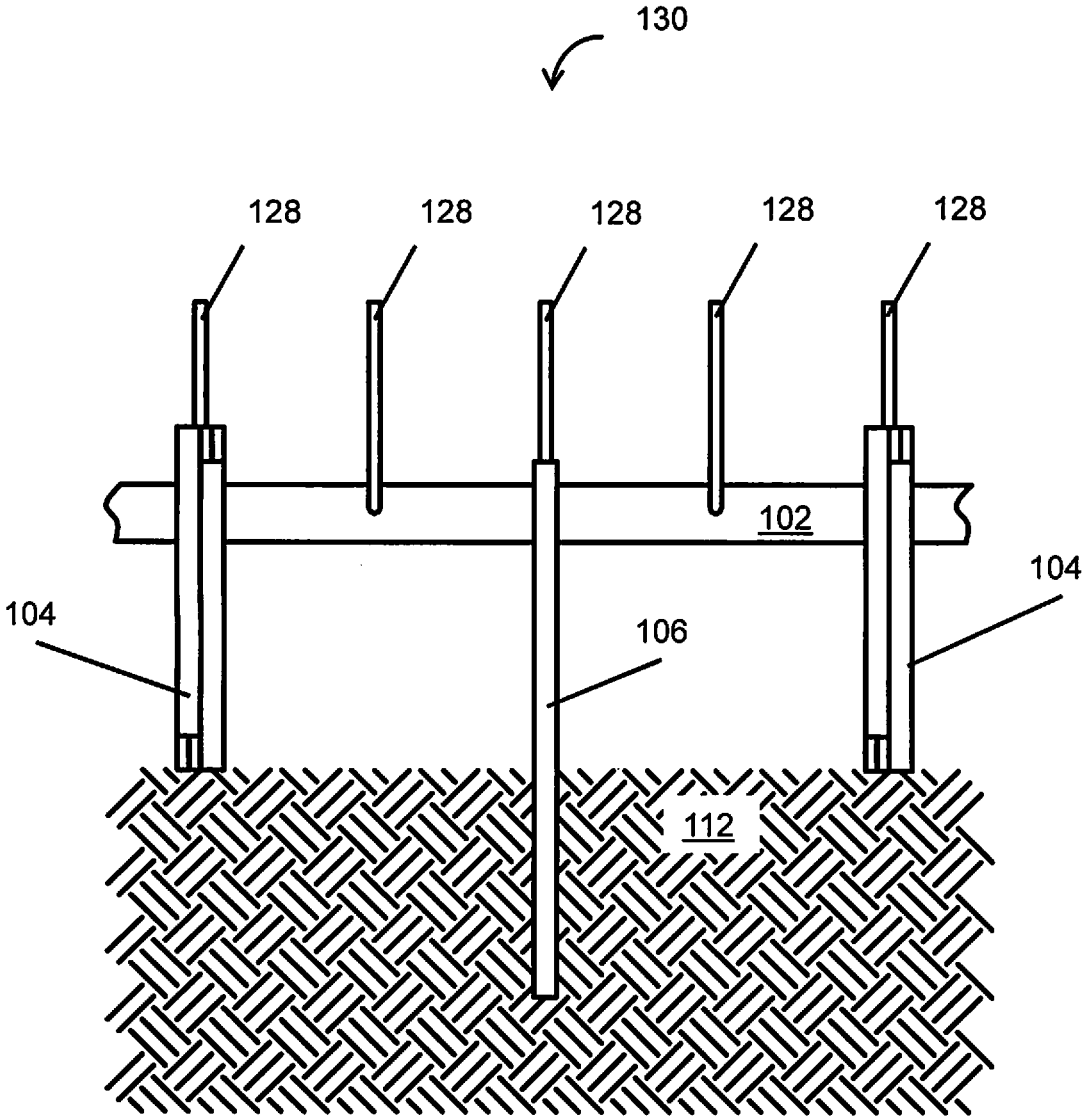
FIG. 6 is a schematic illustration of another embodiment of an access delay vehicle barrier, according to the present invention.

FIG. 6 is a schematic illustration of another embodiment of an access delay vehicle barrier, according to the present invention. Access delay vehicle barrier 130 includes a horizontally disposed barrier member 102 supported above a surface 112 by free standing supports 104 and may include fixed post supports 106. As described above, barrier member 102 can include multiple access delay features. Additionally, vehicle barrier 130 includes a number of vertical barrier sections 128 (e.g. posts and/or pipes) connected (e.g. welded or attached via threaded fasteners) to the barrier member 102 and extending vertically "upward" from the barrier member 102. It can be beneficial in certain applications to include the vertical barrier sections to prevent for example, small vehicles such as all-terrain vehicles ("ATVs") or motorcycles from "jumping" over a vehicle barrier. Additional vertical barrier sections 128 could be connected to the barrier member to extend "downwardly" where desired.

In assembling horizontal sub-sections to form embodiments of a length of horizontal barrier member, sub-sections of the interior steel reinforcing members can be welded together using backing plates as desired and by connecting sub-sections of exterior steel casing again using backing plates where desired. The figures cited above illustrate barrier members having a square tube exterior casing but the use of other shapes, such as round or triangular could be employed as well with no impact to the practice of the invention. It should also be noted that the interior reinforcing members illustrated included I-beams and round stock, while virtually any shape could be selected as convenient for an application, as well as steel cables, chain, laminates of several materials, or any other tensile force resistant medium as noted above. In some applications, it may be desirable to include a plurality of horizontal barrier members having access delay features, in the construction of a vehicle barrier.

The above described exemplary embodiments present several variants of the invention but do not limit the scope of the invention. Those skilled in the art will appreciate that the present invention can be implemented in other equivalent ways. The actual scope of the invention is intended to be defined in the following claims.

What is claimed is:

1. An access delay vehicle barrier comprising:

a barrier member horizontally disposed above a surface by a standoff distance, the barrier member comprising, an exterior casing, an interior reinforcing member, at least one access delay member disposed within the exterior casing and between the exterior casing and the interior reinforcing member;

a vertical support member contacting the barrier member and operatively arranged to support the barrier member above the surface by the standoff distance; and, one or more anchor members each having a first end connected to the barrier member and a second end embedded into the surface, said one or more anchor members operatively arranged to secure the barrier member to the surface;

wherein the at least one access delay member comprises wood; and wherein the interior reinforcing member comprises a steel I-beam and the at least one access delay member comprises one or more wooden members disposed between the steel I-beam and the exterior casing.

2. The vehicle barrier of claim 1, wherein the exterior casing is selected from a group consisting of a square steel tubular casing and a cylindrical steel tubular casing.

3. The vehicle barrier of claim 2, wherein the square steel tubular casing and the cylindrical steal tubular casing comprise steel.

4. The vehicle barrier of claim 1, wherein the interior reinforcing member is selected from the group consisting of a steel I-beam, a steel rod and a steel cable.

5. The vehicle barrier of claim 1, wherein the at least one access delay member is selected from a group consisting of a wooden member, a concrete member, and a polymeric member.

6. The vehicle barrier of claim 1, wherein the vehicle barrier comprises one or more barrier members each having a length horizontally disposed above the surface by the standoff distance.

7. The vehicle barrier of claim 1, wherein the plurality of vertical support members comprise one or more free standing crossed supports attached to the barrier member and operatively arranged to support the barrier member above the surface by the standoff distance.

8. The vehicle barrier of claim 1, wherein the plurality of vertical support members comprise one or more fixed post supports embedded into the surfaced and operatively arranged to impede motion of the barrier member in a direction perpendicular to the length of the barrier member, said fixed post supports disposed along the length of the barrier member.

9. The vehicle barrier of claim 7, wherein the plurality of vertical support members comprise one or more fixed post supports embedded into the surface and operatively arranged to impede motion of the barrier member in a direction perpendicular to the length of the barrier member, said fixed post supports disposed along the length of the barrier member.

10. The vehicle barrier of claim 7 wherein the one or more free standing crossed supports comprise one or more steel I-beam members connected in a cross configuration.

11. The vehicle barrier of claim 1 wherein the one or more anchor members each comprise a concrete mass embedded into the surface, the concrete mass attached to the barrier member by a steel cable.

12. The vehicle barrier of claim 1 wherein the one or more anchor members comprise a fixed post support, the fixed post support embedded into the surface and connected to the barrier member.

13. The vehicle barrier of claim 1, wherein the exterior casing is an exterior steel casing.

14. The vehicle barrier of claim 13 wherein the exterior steel casing comprises a square steel tubular casing and the interior steel reinforcing member comprises a round steel cable.

15. An access delay vehicle barrier comprising:

a barrier member horizontally disposed above a surface by a standoff distance, the barrier member comprising, an exterior steel casing, an interior reinforcing member, at least one access delay member disposed within the exterior casing and between the exterior casing and the interior reinforcing member;

a vertical support member contacting the barrier member and operatively arranged to support the barrier member above the surface by the standoff distance; and, one or more anchor members each having a first end connected to the barrier member and a second end embedded into the surface, said one or more anchor members operatively arranged to secure the barrier member to the surface:

wherein the interior reinforcing member comprises a steel member and the at least one access delay member disposed between the steel member and the exterior casing; and wherein the at least one access delay member is wood.

16. The vehicle barrier of claim 15, wherein the exterior casing is selected from a group consisting of a square steel tubular casing and a cylindrical steel tubular casing.

17. The vehicle barrier of claim 15, wherein the steel member is selected from the group consisting of a steel I-beam, a steel rod and a steel cable.

18. The vehicle barrier of claim 15, wherein the vehicle barrier comprises one or more barrier members each having a length horizontally disposed above the surface by the standoff distance.

* * * * *